US009086674B2

(12) United States Patent
Mekada

(10) Patent No.: US 9,086,674 B2
(45) Date of Patent: Jul. 21, 2015

(54) WASTE TONER COLLECTOR AND IMAGE FORMING APPARATUS

(71) Applicant: Konica Minolta, Inc., Tokyo (JP)

(72) Inventor: Hideki Mekada, Shinshiro (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/963,610

(22) Filed: Aug. 9, 2013

(65) Prior Publication Data

US 2014/0044465 A1 Feb. 13, 2014

(30) Foreign Application Priority Data

Aug. 10, 2012 (JP) ..... 2012-178806

(51) Int. Cl.
*G03G 21/00* (2006.01)
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC ..... G03G 21/105; G03G 21/12; G03G 2221/1624
USPC ..... 399/35, 358, 360
See application file for complete search history.

(56) References Cited

U.S. PATENT DOCUMENTS 4,297,021 A 10/1981 Tani et al.
6,298,217 B1 10/2001 Murayama et al.
2008/0145109 A1* 6/2008 Murayama et al.
2008/0260430 A1* 10/2008 Sakamoto et al.
2009/0136259 A1 5/2009 Ito
2011/0217086 A1 9/2011 Okamoto et al.

FOREIGN PATENT DOCUMENTS

JP 54159983 A 12/1979
JP 03059693 A 3/1991
JP 04109284 A 4/1992

(Continued)

OTHER PUBLICATIONS

Japanese Office Action dated Nov. 26, 2014, issued in counterpart Japanese Application No. 2012-178806.

*Primary Examiner* — Walter L Lindsay, Jr.
*Assistant Examiner* — Milton Gonzalez
(74) *Attorney, Agent, or Firm* — Holtz, Holtz, Goodman & Chick PC

(57) ABSTRACT

A waste toner collector of the present invention includes: a container main body configured to collect and store waste toner; and a conveyance member configured to convey the waste toner in the container main body. The container main body is provided with, on one side wall, a plurality of protruding containing portions that protrude outward from the container main body and are disposed along a longitudinal direction of the container main body, and a plurality of recesses each positioned between adjacent ones of the protruding containing portions. The conveyance member extends along the longitudinal direction of the container main body and is rotatably disposed in the container main body. Waste toner conveyance force of the conveyance member in a rotary shaft direction varies in such a manner that, at border portions between the protruding containing portions and the recesses, the waste toner is pushed toward the protruding containing portions.

6 Claims, 9 Drawing Sheets

(56) References Cited

FOREIGN PATENT DOCUMENTS

| | | | | |
|---|---|---|---|---|
| JP | 05072952 | A | * | 3/1993 |
| JP | 05232846 | A | | 9/1993 |
| JP | 05313544 | A | | 11/1993 |
| JP | 10105012 | A | | 4/1998 |
| JP | 2003015493 | A | * | 1/2003 |
| JP | 2003043887 | A | * | 2/2003 |
| JP | 2007164096 | A | * | 6/2007 |
| JP | 2009-128754 | | | 6/2009 |
| JP | 2011180501 | A | | 9/2011 |
| JP | 2012-042789 | | | 3/2012 |
| JP | 2012108240 | A | * | 6/2012 |

* cited by examiner

WASTE TONER COLLECTOR AND IMAGE FORMING APPARATUS

CROSS-REFERENCE TO RELATED APPLICATIONS

This nonprovisional application claims priority under 35 U.S.C. §119(a) on Patent Application No. 2012-178806 filed in Japan on Aug. 10, 2012, the entire contents of which are hereby incorporated by reference.

BACKGROUND OF THE INVENTION

1. Field of the Invention

The present invention relates to a waste toner collector and an image forming apparatus using the same. The image forming apparatus includes copiers, printers, fax machines, and multi-function machines integrally incorporating copy, printing, and fax capabilities.

2. Discussion of the Background

Conventionally, in an electrophotographic image forming apparatus, waste toner removed from a photoreceptor drum and an intermediate transfer belt by a cleaning device has been conveyed by a conveyance screw to be collected in a waste toner collecting container (see, for example Japanese Unexamined Patent Application Publication No. 2012-42789 and Japanese Unexamined Patent Application Publication No. 2009-128754).

A larger amount of waste toner can be contained with a larger volume of the waste toner collecting container. However, due to the recent demand for downsizing of image forming apparatuses, a space to dispose the waste toner collecting container is limited, and thus it is difficult to increase the size of the waste toner collecting container as a whole. Therefore, to effectively use an empty space in an image forming apparatus, there are many cases where the waste toner collecting container has a complicated outer shape with recesses and protrusions.

However, if the waste toner collecting container has a complicated outer shape with recesses and protrusions as in the conventional practice, it is difficult to distribute the waste toner over a wide area inside the waste toner collecting container. Thus, even when a large volume of the waste toner collecting container is secured, the waste toner is accumulated at a portion in the waste toner collecting container and cannot be sufficiently contained.

SUMMARY OF THE INVENTION

The present invention is made in view of the situation described above, and a technical object thereof is to improve waste toner containing efficiency of a waste toner collector having a complicated shape with recesses and protrusions to secure a large volume.

An embodiment of the present invention is a waste toner collector including: a container main body configured to collect and store waste toner; and a conveyance member configured to convey the waste toner in the container main body. The container main body is provided with, on one side wall, a plurality of protruding containing portions that protrude outward from the container main body and are disposed along a longitudinal direction of the container main body, and a plurality of recesses each positioned between adjacent ones of the protruding containing portions. The conveyance member extends along the longitudinal direction of the container main body and is rotatably disposed in the container main body. Waste toner conveyance force of the conveyance member in a rotary shaft direction varies in such a manner that, at border portions between the protruding containing portions and the recesses, the waste toner is pushed toward the protruding containing portions.

Another embodiment of the present invention is an image forming apparatus including the waste toner collector. The waste toner collector is configured to be attachable and removable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
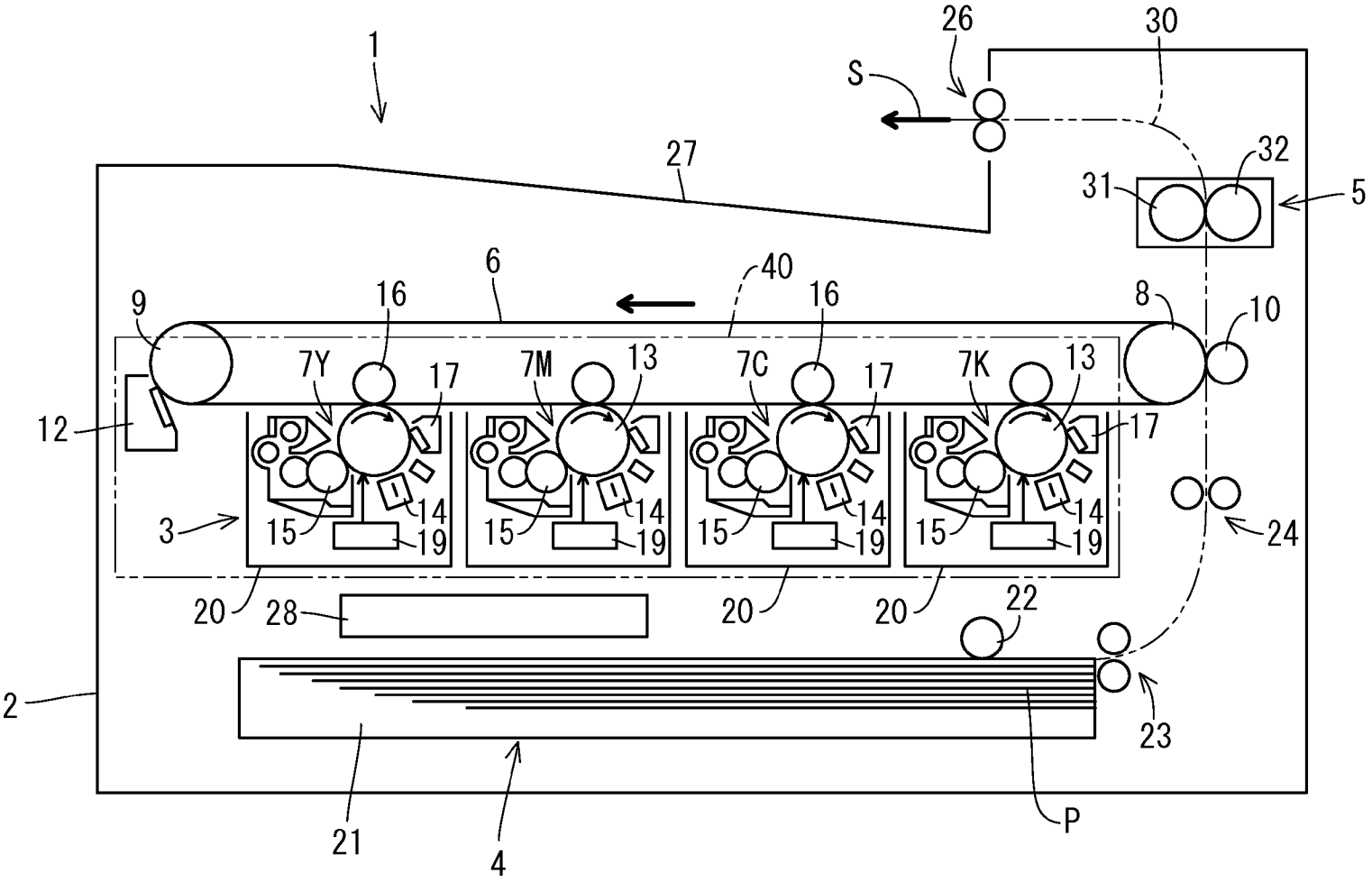
FIG. 1 is a schematic explanation diagram of a printer.
Figure 2:
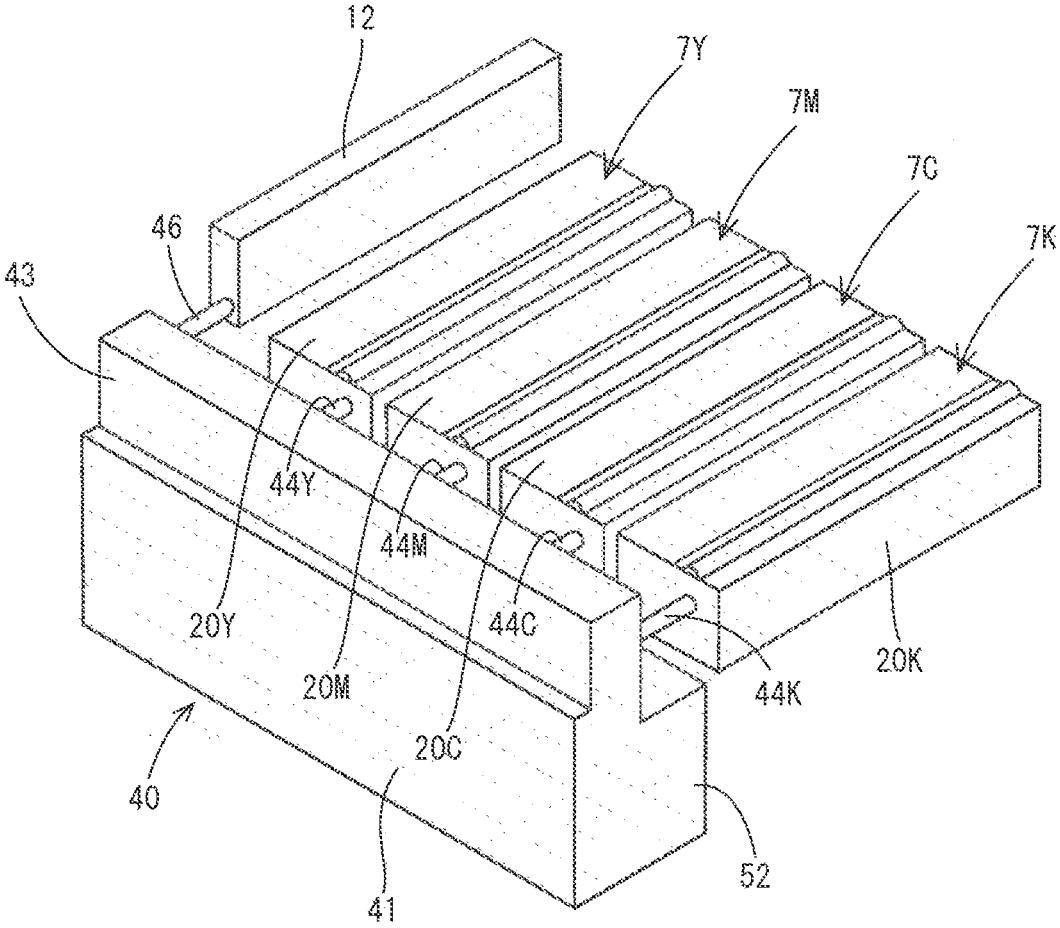
FIG. 2 is an upper front perspective view showing a waste toner collector of a first embodiment and image forming units.
Figure 3:
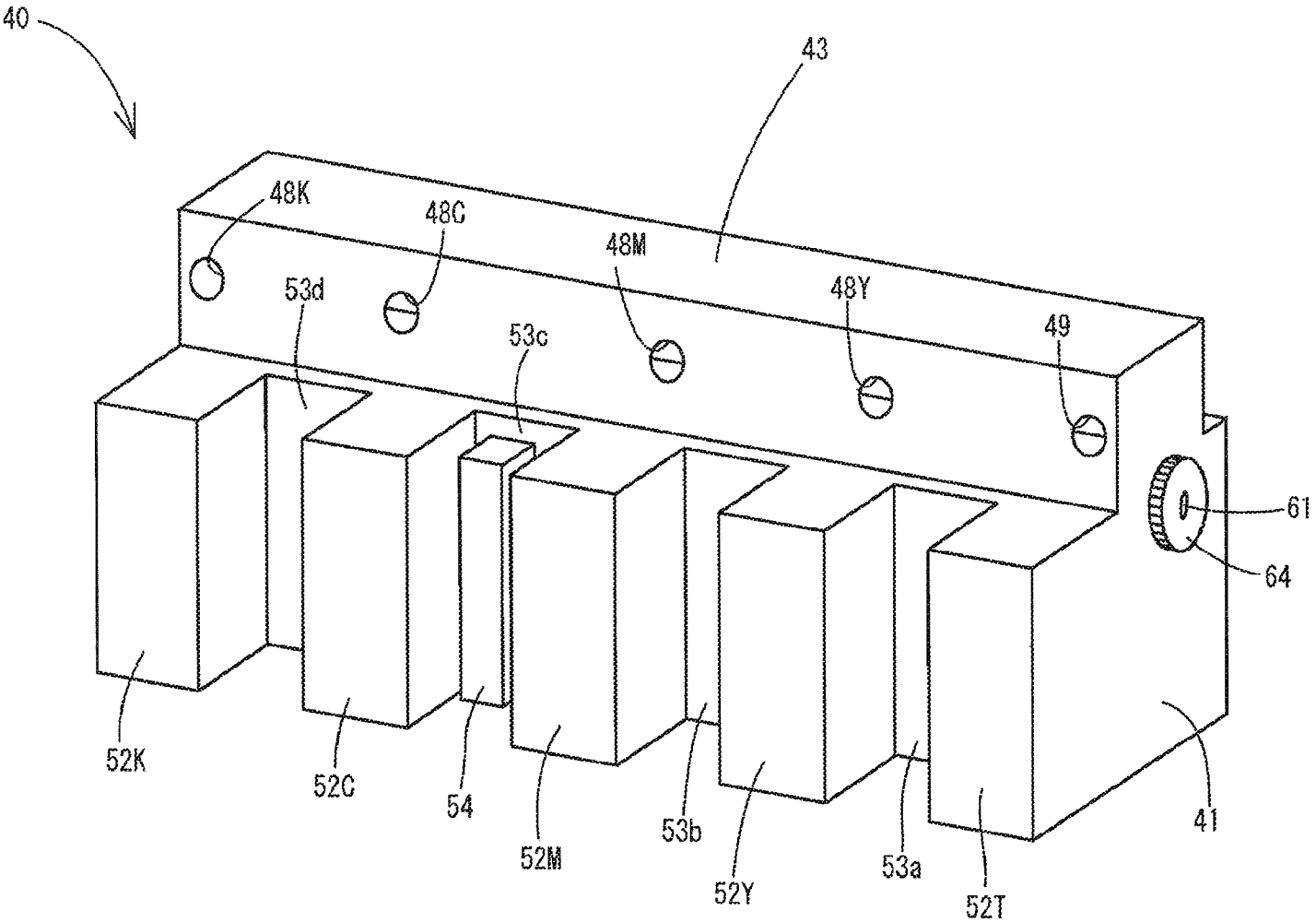
FIG. 3 is an upper rear perspective view of the waste toner collector.

The embodiments will now be described with reference to the accompanying drawings, wherein like reference numerals designate corresponding or identical elements throughout the various drawings.

The embodiments of the present invention is described below on the basis of a tandem color digital printer (hereinafter referred to as a printer) as an example of the image forming apparatus. In the following description, terms (for example, "left and right" and "upper and lower") indicating specific directions and positions are used where necessary. In this respect, the direction perpendicular to the paper plane of FIG. 1 is defined as front view. The terms are used for the sake of description and will not limit the technical scope of the present invention.

1. Overview of the Printer

First, an overview of a printer 1 will be described by referring to FIG. 1. As shown in FIG. 1, the printer 1 according to this embodiment mainly includes, in a casing 2, an image processor 3, a sheet feeder 4, and a fixing device 5. The printer 1 is coupled to a network such as a LAN so that upon receipt of a print command from an external terminal (not shown), the printer 1 executes printing based on the command, which is not elaborated in the drawings.

The sheet feeder 4 is positioned at a lower portion of the casing 2 and includes a sheet feed cassette 21, a pickup roller 22, a pair of separation rollers 23, and a pair of timing rollers 24. The sheet feed cassette 21 accommodates recording media P. The pickup roller 22 picks up an uppermost part of the recording media P in the sheet feed cassette 21. The pair of separation rollers 23 separate the picked part of recording media P into individual sheets. The pair of timing rollers 24 transfer the individual sheets of recording medium P, one by one, to the image processor 3 at a predetermined timing. The recording media P in the sheet feed cassette 21 are sent to a conveyance path 30 one at a time from the top by the rotation of the pickup roller 22 and the separation rollers 23. The conveyance path 30 extends from the sheet feed cassette 21 of the sheet feeder 4 through a nip portion between the pair of timing rollers 24, a secondary transfer nip portion of the image processor 3, and a fixing nip portion of the fixing device 5, to reach a pair of discharging rollers 26 at an upper portion of the casing 2.

In the sheet feed cassette 21, the recording media P are at a center reference for conveyance toward the conveyance path 30 in the direction of the arrow S. In this respect, the center of each recording medium P in its width direction (which is orthogonal to the direction of the arrow S) is used as a reference relative to the center reference. Although not shown in the figure, the sheet feed cassette 21 includes a pair of side regulation plates to align the recording media P with the center reference. The pair of side regulation plates simultaneously move close to or away from one another in the sheet width direction. In the sheet feed cassette 21, the pair of side regulation plates hold both sides of the recording medium P in the sheet width direction. This ensures that recording media P of any standard are set at the center reference in the sheet feed cassette 21. Accordingly, the transfer process at the image processor 3 and the fixing process at the fixing device 5 are executed based on the center reference.

The image processor 3 is above the sheet feeder 4 and transfers toner images on photoreceptor drums 13, which are exemplary image carriers, to a recording medium P. The image processor 3 mainly includes an intermediate transfer belt 6 as an intermediate transfer body and a total of four image forming units 7 respectively corresponding to colors of yellow (Y), magenta (M), cyan (C), and black (K).

The intermediate transfer belt 6, which is another exemplary image carrier, is an endless belt made of a conductive material and is wound across a driving roller 8 and a driven roller 9 respectively disposed on right and left sides at a vertically central position of the casing 2. The intermediate transfer belt 6 rotates in the counter clockwise direction of FIG. 1 as the driving roller 8 is drivingly rotated in the counter clockwise direction of FIG. 1 with power transmitted from a main motor (not shown).

A secondary transfer roller 10 is disposed on the outer peripheral side of a portion of the intermediate transfer belt 6 wound around the driving roller 8. The secondary transfer roller 10 is in contact with the intermediate transfer belt 6. The intermediate transfer belt 6 and the secondary transfer roller 10 define (at the contact portion) a secondary transfer nip portion as a secondary transfer region. The secondary transfer roller 10 rotates in the clockwise direction of FIG. 1 along with the rotation of the intermediate transfer belt 6 or along with the movement of the recording medium P nipped and transferred through the secondary transfer nip portion. A transfer belt cleaner 12 is disposed on an outer peripheral side of a portion of the intermediate transfer belt 6 wound around the driven roller 9. The transfer belt cleaner 12 is in contact with the intermediate transfer belt 6 to remove un-transferred toner remaining on the intermediate transfer belt 6.

Below and along the intermediate transfer belt 6, the four image forming units 7 of yellow (Y), magenta (M), cyan (C), and black (K) are arranged in this order starting on the left side of FIG. 1. In FIG. 1, for the sake of description, reference symbols Y, M, C, and K are given to the respective image forming units 7 in accordance with reproduced colors. The image forming units 7 each include the photoreceptor drum 13 as an exemplary image carrier that is drivingly rotated in the clockwise direction of FIG. 1. Around the photoreceptor drum 13, a charger 14, an exposing device 19, a developer 15, a primary transfer roller 16, and a photoreceptor cleaner 17 are arranged in this order in the clockwise rotational direction of FIG. 1.

The photoreceptor drum 13 is of negatively charged type and is drivingly rotated in the clockwise direction of FIG. 1 with power transmitted from the main motor. The charger 14 uniformly charges the surface of the photoreceptor drum 13. The developer 15 visualizes the electrostatic latent image on the photoreceptor drum 13 by reverse development.

The primary transfer rollers 16 are positioned on an inner peripheral side of the intermediate transfer belt 6. The primary transfer rollers 16 each face the photoreceptor drum 13 of a corresponding one of the image forming units 7 with the intermediate transfer belt 6 interposed therebetween. The primary transfer roller 16 also rotates in the counter clockwise direction of FIG. 1 along with the rotation of the intermediate transfer belt 6. The intermediate transfer belt 6 and each of the primary transfer rollers 16 define (at the contact portion) the primary transfer nip portion as a first primary transfer region. The photoreceptor cleaner 17 is in contact with the photoreceptor drum 13 to remove un-transferred toner remaining on the photoreceptor drum 13. The exposing devices 19 are disposed in the lower portions of the respective four image forming units 7. The exposing devices 19 form an electrostatic latent image on the respective photoreceptor drums 13 using laser beams based on image information from an external terminal and the like.

For example, each image forming unit 7 has a form of a cartridge (integrated structure) with a set of the photoreceptor drum 13, the charger 14, the exposing device 19, the developer 15, and the photoreceptor cleaner 17 incorporated in a housing 20 and is exchangeably (removably) disposed in the casing 2 as what is called a process cartridge. A hopper (not shown) that contains toner to be supplied to each developer 15 is disposed above the intermediate transfer belt 6.

In each of the image forming units 7, the exposing device 19 radiates a laser beam corresponding to an image signal to the photoreceptor drum 13 charged by the charger 14, thus an electrostatic latent image is formed. The electrostatic latent image is reverse developed using toner supplied from the developer 15 into a toner image of a corresponding color. At the primary transfer nip portions, the toner images of yellow, magenta, cyan, and black are primary transferred in this order on the outer circumferential surface of the intermediate transfer belt 6 from the photoreceptor drums 13, and superimposed one on top of each other. Un-transferred toner remaining on the photoreceptor drums 13 is scraped off the photoreceptor drums 13 by the respective photoreceptor cleaners 17. The superimposed toner images of the four colors are collectively secondary transferred on the recording medium P through the secondary transfer nip portion. Un-transferred toner remaining on the intermediate transfer belt 6 is scrapped off the intermediate transfer belt 6 by the transfer belt cleaner 12.

The fixing device 5 is positioned above the secondary transfer roller 10 of the image processor 3, and includes a fixing roller 31 and a pressure roller 32. The fixing roller 31 incorporates a heat source such as a halogen heater. The pressure roller 32 is opposite the fixing roller 31. The fixing roller 31 and the pressure roller 32 define, at the portion of their contact, the fixing nip portion as a fixing region. The recording medium P past the secondary transfer nip portion and loaded with an unfixed toner image is heated and pressed through the fixing nip portion between the fixing roller 31 and the pressure roller 32. Thus, the unfixed toner image is fixed on the recording medium P. Then, the recording medium P is discharged on a collection tray 27 by the rotation of the pair of discharging rollers 26.

The casing 2 includes a controller 28 in charge of overall control of the printer 1 between the image processor 3 and the sheet feeder 4. The controller 28 incorporates another controller (not shown) in charge of various arithmetic operations, storing, and control.

In the casing 2, a waste toner collector 40 is removably mounted on the front side of the image processor 3. The waste toner collector 40 collects the waste toner removed by the transfer belt cleaner 12 and the photoreceptor cleaners 17.

2. First Embodiment of Waste Toner Collector

Next, a first embodiment of the waste toner collector 40 will be described with reference to FIG. 2 to FIG. 6. The waste toner collector 40 on the front side of the image processor 3 in the casing 2 includes a container main body 41 and a dispersion screw 42. The container main body 41 stores therein waste toner (un-transferred toner) removed from the photoreceptor drums 13 and the intermediate transfer belt 6. The dispersion screw 42 serves as a conveyance member that coveys the waste toner in the container main body 41. The container main body 41 has a hollow, laterally long box shape extending over the four image forming units 7 (housings 20) and the transfer belt cleaner 12. The container main body 41 is provided with, on an upper wall side, a waste toner introduction unit 43 protruding upward and extending substantially entirely over the container main body 41 in the longitudinal direction (left-right direction). The waste toner introduction unit 43 is vertically in communication with the container main body 41.

The photoreceptor cleaners 17 of the respective image forming units 7 (the photoreceptor cleaners 17 in the respective housings 20) are removably coupled to the waste toner introduction unit 43 via respective discharge tubes 44. In each of the discharge tubes 44, a discharge screw 45 is rotatably disposed that coveys the waste toner removed from the photoreceptor drum 13 by the photoreceptor cleaner 17 into the waste toner introduction unit 43. The discharge screws 45 are coupled to a common driving motor (not shown) outside the housing 20 in a power transmittable manner. When the discharge screws 45 are rotated by the driving motor, the waste toner is sent into the waste toner introduction unit 43 from the photoreceptor cleaners 17.

The transfer belt cleaner 12 is also removably coupled to the waste toner introduction unit 43 via a conveyance tube 46. In the conveyance tube 46, a conveyance screw 47 is rotatably disposed that coveys the waste toner removed from the intermediate transfer belt 6 by the transfer belt cleaner 12 into the waste toner introduction unit 43. Like the discharge screws 45, the conveyance screw 47 is coupled to the common motor (not shown) in a power transmittable manner. When the conveyance screw 47 is rotated by the driving motor, the waste toner is sent into the waste toner introduction unit 43 from the transfer belt cleaner 12.

In the first embodiment, the waste toner introduction unit 43 is provided with, on a rear surface side (back surface side), insertion holes 48 respectively corresponding to the discharge tubes 44, and a fitting insertion hole 49 corresponding to the conveyance tube 46. The holes are disposed along the longitudinal direction of the waste toner introduction unit 43 at an appropriate interval. Distal end sides of the discharge tubes 44 are removably inserted into the respective insertion holes 48, whereas a distal end side of the conveyance tube 46 is removably inserted into the fitting insertion hole 49. A portion on the distal end side of each of the discharge tubes 44 to be disposed in the waste toner introduction unit 43 is provided with a waste toner outlet 50 of which a lower side is opened. A portion on the distal end side of the conveyance tube 46 to be disposed in the waste toner introduction unit 43 is provided with a waste toner outlet 51 of which a lower side is opened.

For the sake of description, in FIG. 2 to FIG. 6, not only the image forming units 7 but also the housings 20 thereof, the discharge tubes 44, the discharge screws 45, the insertion holes 48 and the waste toner outlets 50 are respectively labeled with symbols Y, M, C, and K in accordance with reproduced colors.

The container main body 41 is further provided with, on the rear wall side, a plurality of protruding containing portions 52 that protrude outwardly toward the rear from the container main body 41 and disposed along the longitudinal direction of the container main body 41, and recesses 53 inwardly recessed toward the front each formed between two adjacent ones of the protruding containing portions 52. Thus, in a plan view, the rear side wall of the container main body 41 has an uneven shape in which the protruding containing portions 52 and the recesses 53 are alternately disposed along the longitudinal direction of the container main body 41. In the first embodiment, the protruding containing portions 52 protrude outward toward the rear for the four image forming units 7 (housings 20) and the transfer belt cleaner 12. Accordingly, in the first embodiment, the protruding containing portions 52 are formed at five portions. Therefore, in the first embodiment, the recesses 53 are formed at four portions each positioned between adjacent ones of the protruding containing portions 52. It is a matter of course that the protruding containing portions 52 are in communication with the container main body 41 in the front and rear direction.

In FIG. 3 to FIG. 6, the protruding containing portions 52 at the positions corresponding to the image forming units 7 (housings 20) are respectively labeled with the reference numerals Y, M, C, and K in accordance with the reproduced colors. The protruding containing portion 52 at the position corresponding to the transfer belt cleaner 12 is labeled with a reference numeral T. The recesses 53 are labeled with alphabets in accordance with the arranged order (for example, the recess between the protruding containing portion 52T and the protruding containing portion 52Y is labeled with a reference numeral 53*a*, the recess between the protruding containing portion 52Y and the protruding containing portion 52M is labeled with a reference numeral 53*b*).

The recess 53*c* between the protruding containing portion 52M and the protruding containing portion 52C is provided with a waste toner detector 54 that detects that the container main body 41 is full of waste toner. The waste toner detector 54 includes a hollow chamber 55 protruding outward toward the rear in the recess 53*c*, and a full load detection sensor 56 disposed at an upper portion of the hollow chamber 55. The hollow chamber 55 and the container main body 41 are partitioned by a partition wall 57. The partition wall 57 does not completely close between the hollow chamber 55 and the container main body 41. The hollow chamber 55 communicates with the container main body 41 only through a portion above the partition wall 57. When the hollow chamber 55 is filled with waste toner, the full load detection sensor 56 at the upper portion of the hollow chamber 55 detects the waste toner and thus it is determined that the container main body 41 is full of waste toner.

Figure 4:
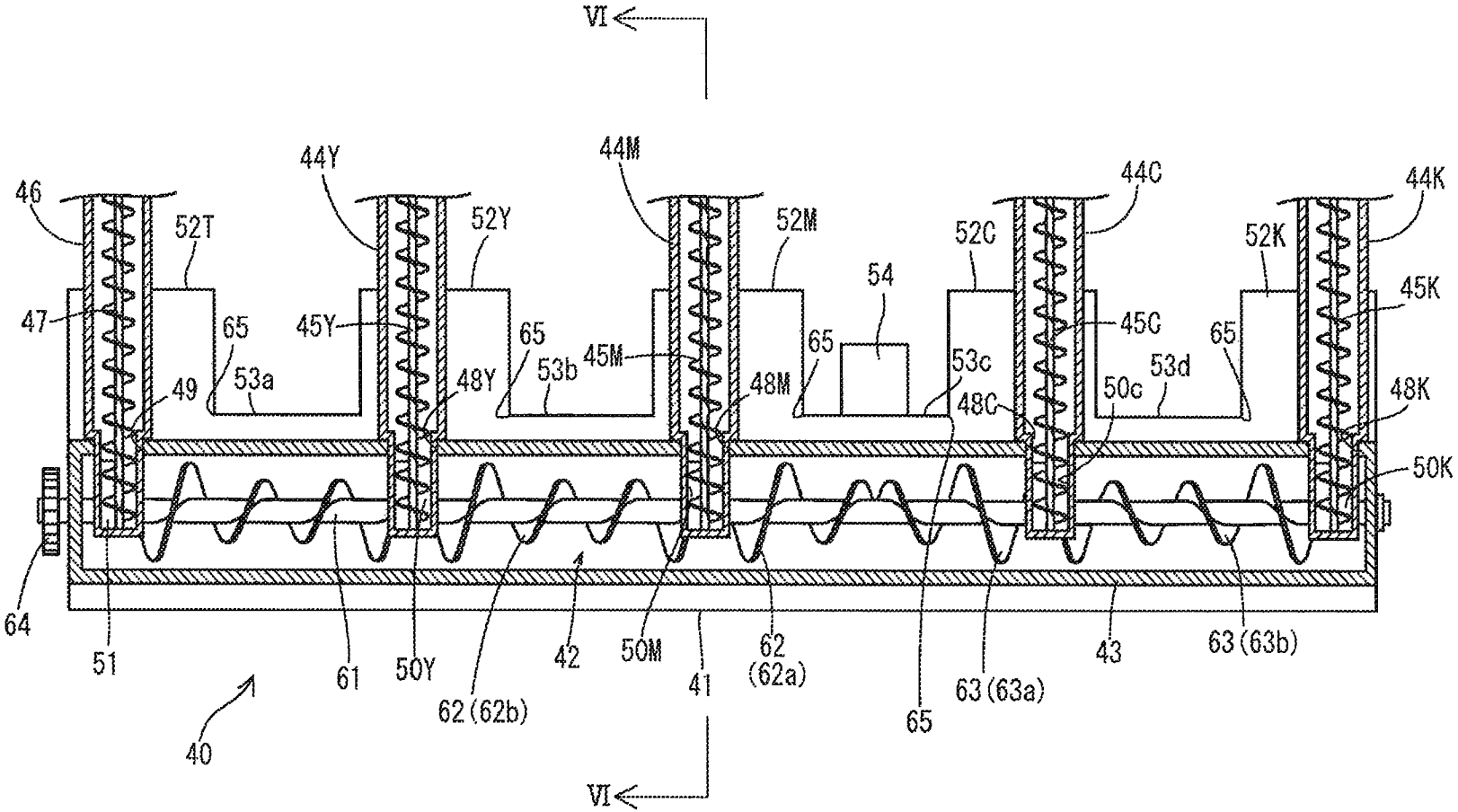
FIG. 4 is a cross-sectional plan view of the waste toner collector showing a relationship between discharge tubes and a conveyance tube and a waste toner introduction unit.
Figure 5:
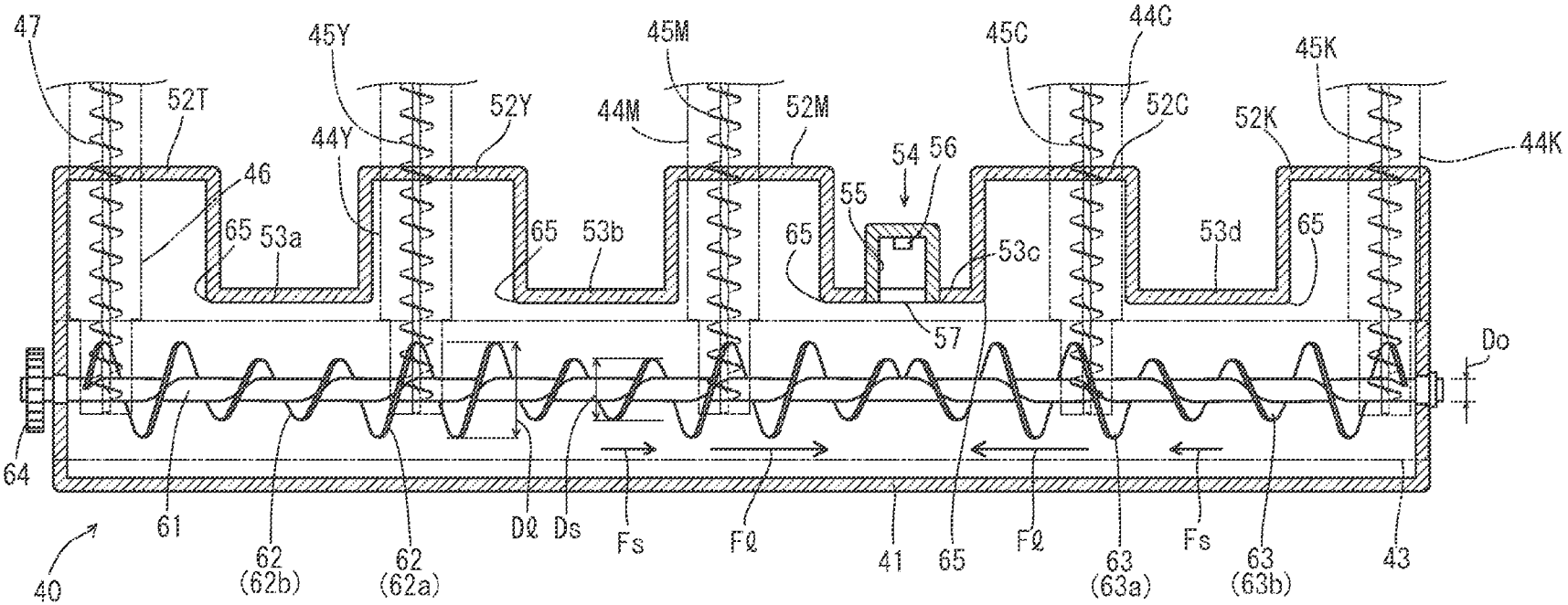
FIG. 5 is a cross-sectional plan view of the waste toner collector showing a relationship between a conveyance screw and protruding containing portions and recesses.
Figure 6:
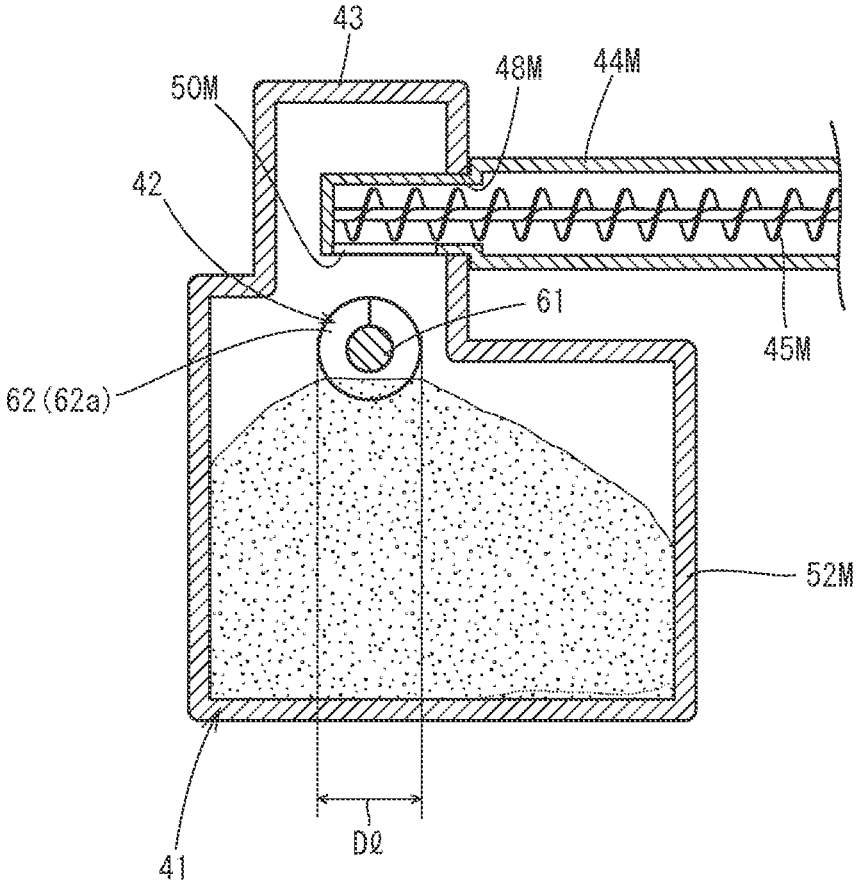
FIG. 6 is a cross-sectional side view taken along the line VI-VI in FIG. 4.

As shown in FIG. 4 to FIG. 6, the dispersion screw 42 as a conveyance member that coveys the waste toner in the container main body 41 extends in the longitudinal direction of the container main body 41 and is rotatably disposed in the container main body 41. The dispersion screw 42 is disposed on an upper side of the container main body 41 and right below the waste toner introduction unit 43. The dispersion screw 42 of the first embodiment includes a rotary shaft 61 that extends along the longitudinal direction of the container main body 41. Both longitudinal ends of the rotary shaft 61 are respectively rotatably supported by the left and the right walls of the container main body 41. The rotary shaft 61 is provided with, on an outer periphery, spiral shaped screw blades 62 and 63 extending from the longitudinal ends to an intermediate portion in the longitudinal direction of the rotary shaft 61 and having screw directions opposite to each other.

In the first embodiment, the discharge tube 44 and conveyance tube 46 of the image forming unit 7K (housing unit 20K) and the transfer belt cleaner 12 that produce a large amount of waste toner are respectively positioned at both ends of the container main body 41 (waste toner introduction unit 43) in the longitudinal direction. Thus, the waste toner is likely to be piled up on the both end sides of the container main body 41 in the longitudinal direction. Accordingly, the screw directions of the screw blades 62 and 63 are reversed at a portion on the rotary shaft 61 corresponding to the recess 53*c* provided with the waste toner detector 54. As the dispersion screw 42 rotates, the waste toner is stirred and is conveyed toward the recess 53*c* provided with the waste toner detector 54. As a result, the piles of waste toner on both end sides of the container main body 41 in the longitudinal direction are smoothed, and thus the waste toner is distributed over the longitudinal direction in the container main body 41.

The rotary shaft 61 is provided with a driving gear 64 at a protruding portion protruding outward from the left wall of the container main body 41. The driving gear 64 is coupled to the driving motor described above in a power transmittable manner through a power transmission system such as a gear train (not shown). As the dispersion screw 42 is rotated by the driving motor, in the container main body 41, the waste toner is stirred and conveyed toward the recess 53*c* provided with the waste toner detector 54.

In the first embodiment, the rotary shaft 61 has a uniform diameter Do over the entire length. In the screw blades 62 and 63, an outer diameter Ds of portions 62*b* and 63*b* corresponding to the recesses 53 is smaller than an outer diameter Dl of portions 62*a* and 63*a* corresponding to the protruding containing portions 52. Thus, in the screw blades 62 and 63, waste toner conveyance force Fs at the portions 62*b* and 63*b* corresponding to the recesses 53 is smaller than waste toner conveyance force Fl at the portions 62*a* and 63*a* corresponding to the protruding containing portions 52 (in the dispersion screw 42, the waste toner conveyance force Fl and Fs in the rotary shaft direction varies).

When the waste toner is conveyed by the rotation of the dispersion screw 42, in the container main body 41, at border portions 65 between the protruding containing portions 52 and the recesses 53, the outer diameters of the screw blades 62 and 63 decrease from Dl to Ds, and the waste toner conveyance force of the dispersion screw 42 decreases from Fl to Fs. Thus, around the border portions 65, (following) waste toner on the upstream side in the conveyance direction of which the conveyance speed is high comes in contact with (preceding) waste toner on the downstream side in the conveyance direction of which the conveyance speed is low. Thus, the flow of the waste toner toward the recess 53*c* provided with the waste toner detector 54 stops and the waste toner is piled up. The waste toner conveyed thereafter further comes in contact with the pile of waste toner. Thus, the pile is pushed in a direction F into the protruding containing portion 52 as an empty space, whereby the waste toner is contained (dispersed) in the protruding containing portion 52.

Thus, in the configuration of the first embodiment, the empty space in the printer 1 is effectively utilized. Accordingly, even if the container main body 41 has a complicated outer shape with recesses and protrusions, the waste toner can be widely distributed over the entire space in the container main body 41. As a result, the waste toner containing efficiency of the container main body 41 can be improved. Moreover, the dispersion screw 42 is the only required dedicated member configured to convey the waste toner into the protruding containing portion 52, whereby the number of parts can be reduced and the attempt to reduce the cost is facilitated.

3. Second Embodiment of Waste Toner Collector

Figure 7:
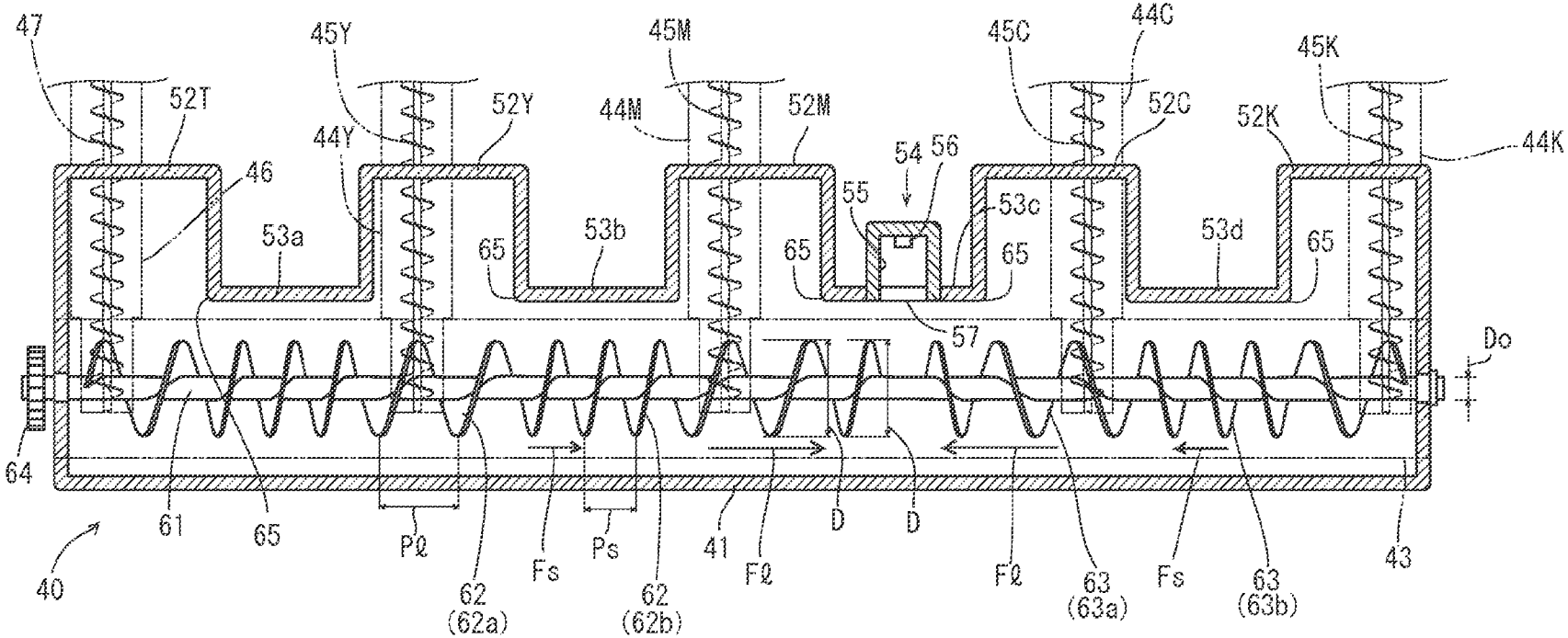
FIG. 7 is a cross-sectional plan view of a waste toner collector showing a relationship between a conveyance screw and protruding containing portion and a recess in a second embodiment.

FIG. 7 shows a second embodiment of the waste toner collector 40. Here, in this alternative embodiment of the waste toner collector 40 described below, components of which the configuration and the operation are the same as the counterparts of the first embodiment are denoted with the same reference numerals and will not be described in detail. The waste toner collector 40 of the second embodiment shown in FIG. 7 has the same configuration as that of the first embodiment except for the following point. Specifically, the screw blades 62 and 63 of dispersion screw 42 each have the uniform outer diameter D over the entire length, but in the screw blades 62 and 63, a pitch Ps in the portions 62*b* and 63*b* corresponding to the recesses 53 is smaller than a pitch Pl in the portions 62*a* and 63*a* corresponding to the protruding containing portions 52.

As described above, in the screw blades 62 and 63, the pitch Ps in the portions 62*b* and 63*b* corresponding to the recesses 53 is smaller than the pitch Pl in the portions 62*a* and 63*a* corresponding to the protruding containing portions 52. Thus, as in the first embodiment, in the screw blades 62 and 63, the waste toner conveyance force Fs at the portions 62*b* and 63*b* corresponding to the recesses 53 is smaller than waste toner conveyance force Fl at the portions 62*a* and 63*a* corresponding to the protruding containing portions 52. Also in this configuration, around the border portions 65, (following) waste toner on the upstream side in the conveyance direction of which the conveyance speed is high comes in contact with (preceding) waste toner on the downstream side in the conveyance direction of which the conveyance speed is low. Thus, the flow of the waste toner toward the recess 53*c* provided with the waste toner detector 54 stops and the waste toner is piled up. The waste toner conveyed thereafter further comes in contact with the pile of waste toner. Thus, the pile is pushed in the direction F into the protruding containing portion 52 as an empty space, whereby the waste toner is contained (dispersed) in the protruding containing portion 52. The toner collector 40 of the second embodiment can also provide the effect that is the same as that of the first embodiment.

4. Third Embodiment of Waste Toner Collector

Figure 8:
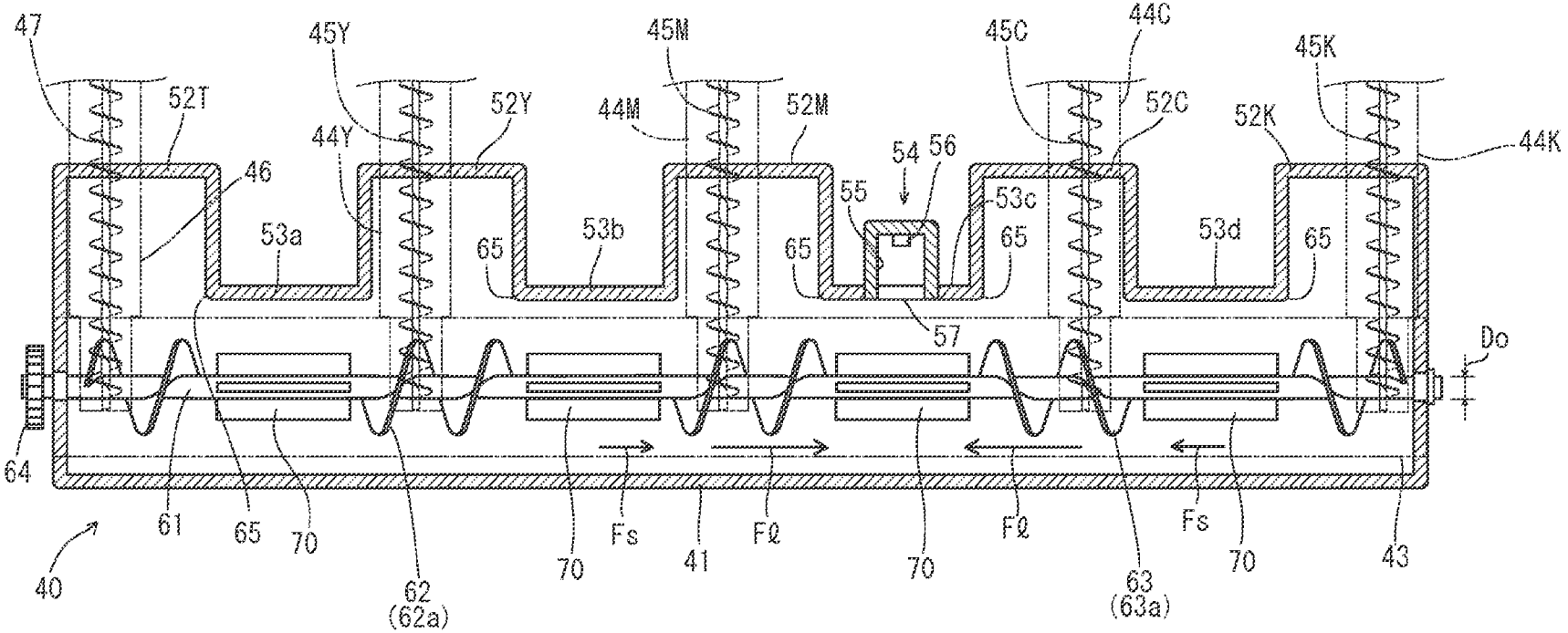
FIG. 8 is a cross-sectional plan view of a waste toner collector showing a relationship between a conveyance screw and protruding containing portion and a recess in a third embodiment.

FIG. 8 shows a third embodiment of the waste toner collector 40. The waste toner collector 40 of the third embodiment shown in FIG. 8 has the same configuration as that of the first embodiment except for the following point. Specifically, the rotary shaft 61 has the screw blades 62 and 63 at portions corresponding to the protruding containing portions 52, and paddle blades 70 at portions corresponding to the recesses 53.

The paddle blade 70 is involved in the stirring of the waste toner piled up around the recess 53 of the container main body 41, but is not involved in the conveyance of the waste toner from the both ends to the intermediate portion of the container main body 41 in the longitudinal direction. Thus, in the dispersion screw 42, the waste toner conveyance force Fs of the paddle blades 70 corresponding to the recesses 53 is almost zero, and thus is smaller than the waste toner conveyance force Fl of the screw blades 62 and 63 corresponding to the protruding containing portions 52.

Also in this configuration, around the border portions 65, (following) waste toner on the upstream side in the conveyance direction of which the conveyance speed is high comes in contact with (preceding) waste toner on the downstream side in the conveyance direction of which the conveyance speed is low. Thus, the flow of the waste toner toward the recess 53*c* provided with the waste toner detector 54 stops and the waste toner is piled up. The waste toner conveyed thereafter further comes in contact with the pile of waste toner. Thus, the pile is pushed in the direction F into the protruding containing portion 52 as an empty space, whereby the waste toner is contained (dispersed) in the protruding containing portion 52. The toner collector 40 of the third embodiment can also provide the effect that is the same as that of the first embodiment.

5. Fourth Embodiment of Waste Toner Collector

Figure 9:
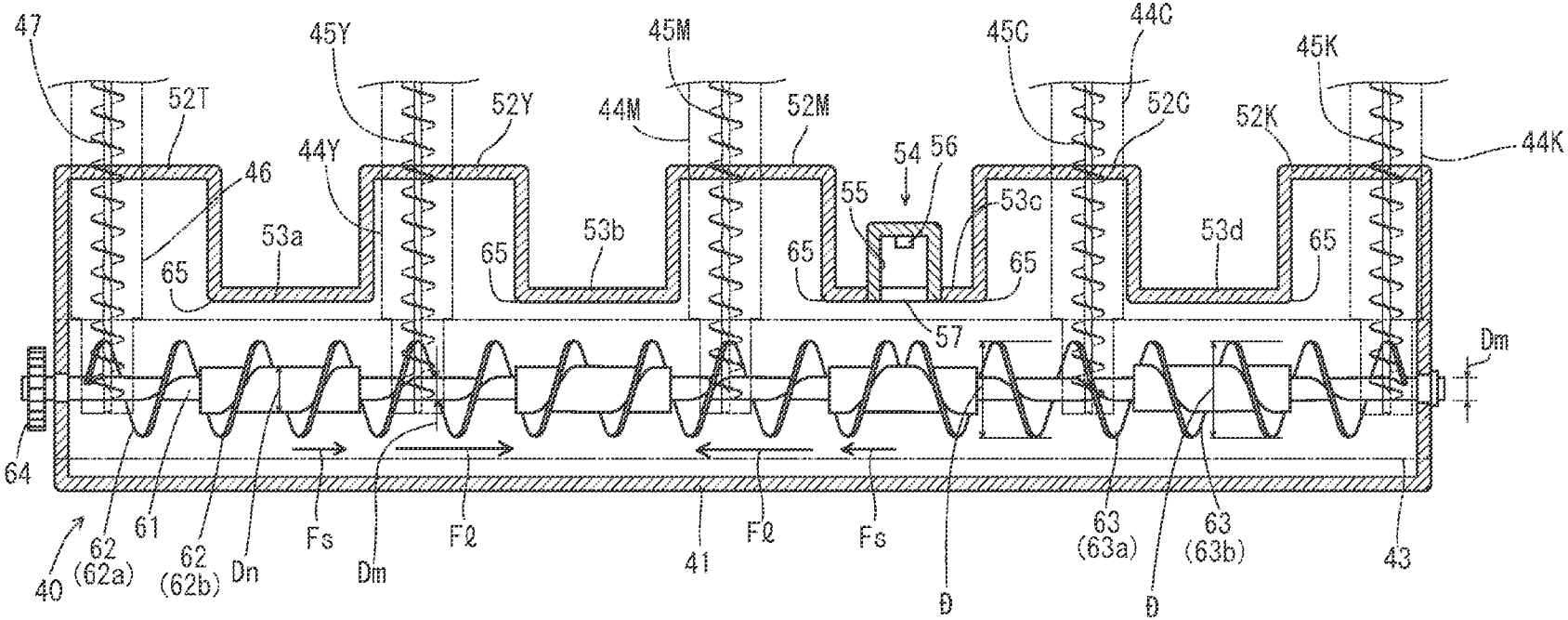
FIG. 9 is a cross-sectional plan view of a waste toner collector showing a relationship between a conveyance screw and protruding containing portion and a recess in a fourth embodiment.

FIG. 9 shows a fourth embodiment of the waste toner collector 40. The waste toner collector 40 of the fourth embodiment shown in FIG. 9 has the same configuration as that of the first embodiment except for the following point. Specifically, the screw blades 62 and 63 each have the uniform outer diameter D over the entire length, and in the rotary shaft 61, a diameter Dn of the portions corresponding to the recesses 53 is larger than a diameter Dm of the portions corresponding to the protruding containing portions 52.

Also in this configuration, in the screw blades 62 and 63, the waste toner conveyance force Fs at the portions 62*b* and 63*b* corresponding to the recesses 53 is smaller than waste toner conveyance force Fl at the portions 62*a* and 63*a* corresponding to the protruding containing portions 52 as in the first embodiment. Thus, around the border portions 65, (following) waste toner on the upstream side in the conveyance direction of which the conveyance speed is high comes in contact with (preceding) waste toner on the downstream side in the conveyance direction of which the conveyance speed is low. The flow of the waste toner toward the recess 53*c* provided with the waste toner detector 54 stops and the waste toner is piled up. The waste toner conveyed thereafter further comes in contact with the pile of waste toner. Thus, the pile is pushed in the direction F into the protruding containing portion 52 as an empty space, whereby the waste toner is contained (dispersed) in the protruding containing portion 52. The toner collector 40 of the fourth embodiment can also provide the effect that is the same as that of the first embodiment.

6. Others

The present invention is not limited to the above-described embodiments and can be embodied in various forms. For example, while a printer has been described as an exemplary image forming apparatus, this should not be construed in a limiting sense. Other possible examples include copiers, fax machines, and multi-function machines integrally incorporating copy and fax capabilities. Moreover, the location or arrangement of individual elements in the illustrated embodiments should not be construed in a limiting sense. Various modifications can be made without departing from the scope of the present invention.

According to an embodiment of the present invention, waste toner conveyance force of a conveyance member in a rotary shaft direction varies in such a manner that, at border portions between protruding containing portions and recesses, waste toner is pushed toward the protruding containing portions. Thus, an empty space in an image forming apparatus is effectively utilized. Accordingly, even if the container main body has a complicated outer shape with recesses and protrusions, the waste toner can be widely distributed (dispersed) over the entire space in the container main body. As a result, the waste toner containing efficiency of the container main body can be improved. Moreover, the conveyance member is the only required dedicated member configured to convey the waste toner into the protruding containing portion, whereby the number of parts can be reduced and the attempt to reduce the cost is facilitated.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A waste toner collector comprising:

a container main body configured to collect and store waste toner; and a conveyance member comprising a rotary shaft which extends along a longitudinal direction of the container main body, the conveyance member being configured to convey the waste toner in the container main body along a rotary shaft direction corresponding to the longitudinal direction of the container main body, wherein the container main body is provided with, on one side wall, a plurality of protruding containing portions that protrude outward from the container main body and are disposed along the longitudinal direction of the container main body, and a plurality of recesses each positioned between adjacent ones of the protruding containing portions, wherein the conveyance member is rotatably disposed in the container main body, wherein the conveyance member is configured to have a variable waste toner conveyance force along the rotary shaft direction in which the waste toner is conveyed, the waste toner conveyance force being a force which conveys the waste toner in the rotary shaft direction, and wherein the waste toner conveyance force of the conveyance member is varied along the rotary shaft direction to be larger at portions of the rotary shaft corresponding to the protruding containing portions than at portions of the rotary shaft corresponding to the recesses, the waste toner conveyance force varying at border portions between the protruding containing portions and the recesses, such that at the border portions, the waste toner is pushed toward the protruding containing portions.

2. The waste toner collector according to claim 1, wherein the conveyance member further comprises a screw blade attached to the rotary shaft, and wherein an outer diameter of the screw blade at the portions corresponding to the recesses is smaller than an outer diameter of the screw blade at the portions corresponding to the protruding containing portions.

3. The waste toner collector according to claim 1, wherein the conveyance member further comprises a screw blade attached to the rotary shaft, and wherein a pitch of the screw blade at the portions corresponding to the recesses is smaller than a pitch of the screw blade at the portions corresponding to the protruding containing portions.

4. The waste toner collector according to claim 1, wherein the conveyance member further comprises screw blades attached to the portions of the rotary shaft corresponding to the protruding containing portions, and paddle blades attached to the portions of the rotary shaft corresponding to the recesses.

5. The waste toner collector according to claim 1, wherein the conveyance member further comprises a screw blade attached to the rotary shaft, and wherein a diameter of the rotary shaft at the portions corresponding to the recesses is larger than a diameter of the rotary shaft at the portions corresponding to the protruding containing portions.

6. An image forming apparatus comprising the waste toner collector according to claim 1, wherein the waste toner collector is configured to be attachable to and removable from the image forming apparatus.

* * * * *